US010777179B2

(12) United States Patent
Yoshino

(10) Patent No.: US 10,777,179 B2
(45) Date of Patent: Sep. 15, 2020

(54) ELECTRONIC PERCUSSION INSTRUMENT

(71) Applicant: Roland Corporation, Shizuoka (JP)

(72) Inventor: Kiyoshi Yoshino, Shizuoka (JP)

(73) Assignee: Roland Corporation, Shizuoka (JP)

( * ) Notice: Subject to any disclaimer, the term of this patent is extended or adjusted under 35 U.S.C. 154(b) by 0 days.

(21) Appl. No.: 16/280,054

(22) Filed: Feb. 20, 2019

(65) Prior Publication Data

US 2019/0266989 A1 Aug. 29, 2019

(30) Foreign Application Priority Data

Feb. 26, 2018 (JP) ..... 2018-031630

(51) Int. Cl.

| | |
|---|---|
| ***G10H 3/14*** | (2006.01) |
| ***G10H 1/32*** | (2006.01) |
| ***G10D 13/02*** | (2020.01) |
| ***G10D 13/10*** | (2020.01) |

(52) U.S. Cl.

CPC ..... *G10H 3/146* (2013.01); *G10D 13/02* (2013.01); *G10D 13/26* (2020.02); *G10H 1/32* (2013.01); *G10H 3/143* (2013.01); *G10H 2230/285* (2013.01)

(58) Field of Classification Search

CPC .... G10D 13/024; G10D 13/006; H01L 41/04; G10H 3/146; G10H 2230/291; G10H 2220/525; G10H 1/32

USPC ..... 84/104

See application file for complete search history.

(56) References Cited

U.S. PATENT DOCUMENTS

| | | | | |
|---|---|---|---|---|
| 4,344,349 | A | 8/1982 | Cordes | |
| 7,612,273 | B2 * | 11/2009 | Matsuyuki | G10D 13/024 84/411 A |
| 8,884,151 | B1 * | 11/2014 | Lee | G10H 3/146 84/464 R |
| 9,006,555 | B2 * | 4/2015 | Mori | G10H 3/14 84/104 |
| 9,343,048 | B2 * | 5/2016 | Shepherd | G10D 13/021 |
| 9,536,509 | B2 * | 1/2017 | Esparza | G10D 13/024 |
| 9,672,802 | B2 * | 6/2017 | Muzzio | G10H 3/146 |

(Continued)

FOREIGN PATENT DOCUMENTS

| | | |
|---|---|---|
| CN | 101853657 | 5/2013 |
| EP | 2793220 | 10/2014 |
| JP | 2018031630 | 3/2018 |

OTHER PUBLICATIONS

Roland Corporation, "Rhythm Coach RMP-3 Orner's Manual," 2005, pp. 1-10.

(Continued)

*Primary Examiner* — Jeffrey Donels

(74) *Attorney, Agent, or Firm* — JCIPRNET

(57) ABSTRACT

There is provided an electronic percussion instrument including: a body part having an opening on at least one end side of the body part; a head that covers the opening of the body part; a hoop for applying tension to the head, a rim which is disposed on an inner circumferential side of the hoop and of which an upper end is positioned above an upper end of the hoop and of which a bottom surface is supported on an edge of the opening of the body part via the head; and a rim sensor that detects vibration generated when the rim is struck and is disposed in the body part.

19 Claims, 3 Drawing Sheets

(56) References Cited

U.S. PATENT DOCUMENTS

| | | | | |
|---|---|---|---|---|
| 2004/0025663 | A1* | 2/2004 | Harada | G10D 13/024 84/104 |
| 2013/0180388 | A1 | 7/2013 | Mori | |

OTHER PUBLICATIONS

Roland Corporation, "Rhythm Coach RMP-5 Orner's Manual," 2005, pp. 1-36.
"Search Report of Europe Counterpart Application", dated Jul. 24, 2019, pp. 1-7.

* cited by examiner

ELECTRONIC PERCUSSION INSTRUMENT

CROSS-REFERENCE TO RELATED APPLICATION

This application claims the priority benefit of Japan Application No. 2018-031630, filed on Feb. 26, 2018. The entirety of the above-mentioned patent application is hereby incorporated by reference herein and made a part of this specification.

BACKGROUND

Technical Field

The disclosure relates to an electronic percussion instrument, and particularly, to an electronic percussion instrument that can efficiently transmit vibration generated when a rim is struck to a rim sensor.

Description of Related Art

An electronic percussion instrument including a rim cover that protects a rim from being struck by a performer and a rim sensor configured to detect vibration generated when the rim cover is struck is known. For example, in Patent Document 1, an electronic percussion instrument including an annular outer peripheral part which is connected to a head support member of a body part and disposed on the outer circumferential side relative to a hoop and in which a rim cover is fitted to an upper end of the outer peripheral part is described. According to this electronic percussion instrument, since an upper end of the rim cover is positioned above the hoop, the hoop can be protected from being struck by the rim cover.

However, in this related art, the outer peripheral part to which the rim cover is fitted is formed to protrude radially outward from the head support member of the body part and extend upward, and the rim sensor configured to detect vibration generated when the outer peripheral part (rim cover) is struck is supported on the inner circumferential side of the head support member. Therefore, since vibration generated when the rim cover is struck is transmitted to the rim sensor through the outer peripheral part, there is a problem that a vibration transmission path (distance) from the rim cover to the rim sensor becomes longer and it is difficult to transmit vibration generated when the rim (rim part) is struck to the rim sensor.

On the other hand, the applicant proposes use of a configuration in which a rim is disposed on the inner circumferential side of a hoop in the electronic percussion instrument of the related art. Here, a configuration of an electronic percussion instrument 101 of the related art will be described with reference to FIG. 3. FIG. 3 is a cross-sectional view of the electronic percussion instrument 101 of the related art. The symbol 120 (102) in FIG. 3 means the cylindrical part 120 of the body part 102, the other symbols marked as the same way are the same meanings.

The electronic percussion instrument 101 includes a body part 102 having an opening on the upper end side, a head 103 that covers the opening of the body part 102, a hoop 104 that applies tension to the head 103, and a rim 105 that protects the hoop 104 from being struck and is disposed on the inner circumferential side of the hoop 104.

The body part 102 includes a cylindrical part 120 having a cylindrical shape of which a lower end side is blocked and a fixing part 121 that protrudes radially outward from the outer circumferential surface of the lower end side of the cylindrical part 120. When a bolt B inserted into a through-hole of the hoop 104 is screwed into the fixing part 121, the hoop 104 is fastened and fixed to the fixing part 121.

The head 103 includes a disk-shaped film part 130 constituting a struck surface and an annular frame part 131 that is connected to the outer edge of the film part 130. When the film part 130 is connected to the upper surface on the inner circumferential side of the frame part 131, the upper surface on the outer circumferential side of the frame part 131 is exposed. When this exposed part is pushed downward by the hoop 104 (the hoop 104 is fastened and fixed to the fixing part 121), tension is applied to the film part 130.

The rim 105 includes an annular struck part 150 formed with a substantially U-shaped cross section and a clamped part 151 that protrudes radially outward from the outer edge of the struck part 150 and is formed using a rubber-like elastic component. The clamped part 151 is intermittently formed in the circumferential direction of the rim 105. When the clamped part 151 is clamped between the upper surface of the frame part 131 and the hoop 104, the struck part 150 is fixed along the inner circumferential surface of the hoop 104.

Since the upper end of the struck part 150 is positioned above the upper end of the hoop 104, the hoop 104 can be protected from being struck by the rim 105. In addition, since the struck part 150 is formed in a U-shaped cross section (hollow shape) using a rubber-like elastic component, it is possible to reduce a striking sound generated by striking the struck part 150.

PATENT DOCUMENTS

[Patent Document 1] Japanese Unexamined Patent Application Publication No. 2007-249141 (for example, 0025, 0038, and 0039, FIG. 5 (*b*))

However, the above electronic percussion instrument 101 of the related art includes a head sensor S on the inner circumferential side of the cylindrical part 120, but it does not have a rim sensor. In addition, even if a rim sensor is supported on the cylindrical part 120 of the electronic percussion instrument 101 of the related art, it is not possible to efficiently transmit vibration generated when the rim 105 is struck to the rim sensor.

That is, a part on the inner circumferential side of the struck part 150 is supported on the cylindrical part 120 via the film part 130 on the outer circumferential side relative to the upper end of the cylindrical part 120, and a part on the outer circumferential side of the struck part 150 is supported on the upper surface of the frame part 131. Therefore, since a part of vibration generated when the rim 105 is struck is transmitted to the cylindrical part 120 through the frame part 131 and the film part 130, it is not possible to efficiently transmit vibration generated when the rim 105 is struck to the cylindrical part 120.

In addition, while a part of vibration generated when the rim 105 is struck is transmitted to the cylindrical part 120 of the body part 102 from the struck part 150 through the film part 130, since a part on the inner circumferential side of the struck part 150 is positioned on the outer circumferential side relative to the upper end of the cylindrical part 120, it is difficult to directly transmit vibration generated when the struck part 150 is struck to the cylindrical part 120. In addition, since the struck part 150 is formed with a U-shaped cross section (hollow shape) using a rubber-like elastic component, the struck part 150 is easily elastically deformed by striking, and a striking force is buffered by the struck part 150. Therefore, it is not possible to efficiently transmit vibration generated when the rim 105 is struck to the cylindrical part 120.

That is, the above techniques of the related art have a problem that it is not possible to efficiently transmit vibration generated when a rim is struck to a rim sensor.

SUMMARY

An electronic percussion instrument includes: a body part having an opening on at least one end side of the body part; a head that covers the opening of the body part; a hoop for applying tension to the head, a rim which is disposed on an inner circumferential side of the hoop and of which an upper end is positioned above an upper end of the hoop and of which a bottom surface is supported on an edge of the opening of the body part via the head; and a rim sensor that detects vibration generated when the rim is struck and is disposed in the body part.

DESCRIPTION OF THE EMBODIMENTS

One of the embodiments of the disclosure provides an electronic percussion instrument that can efficiently transmit vibration generated when a rim is struck to a rim sensor.

Figure 1:
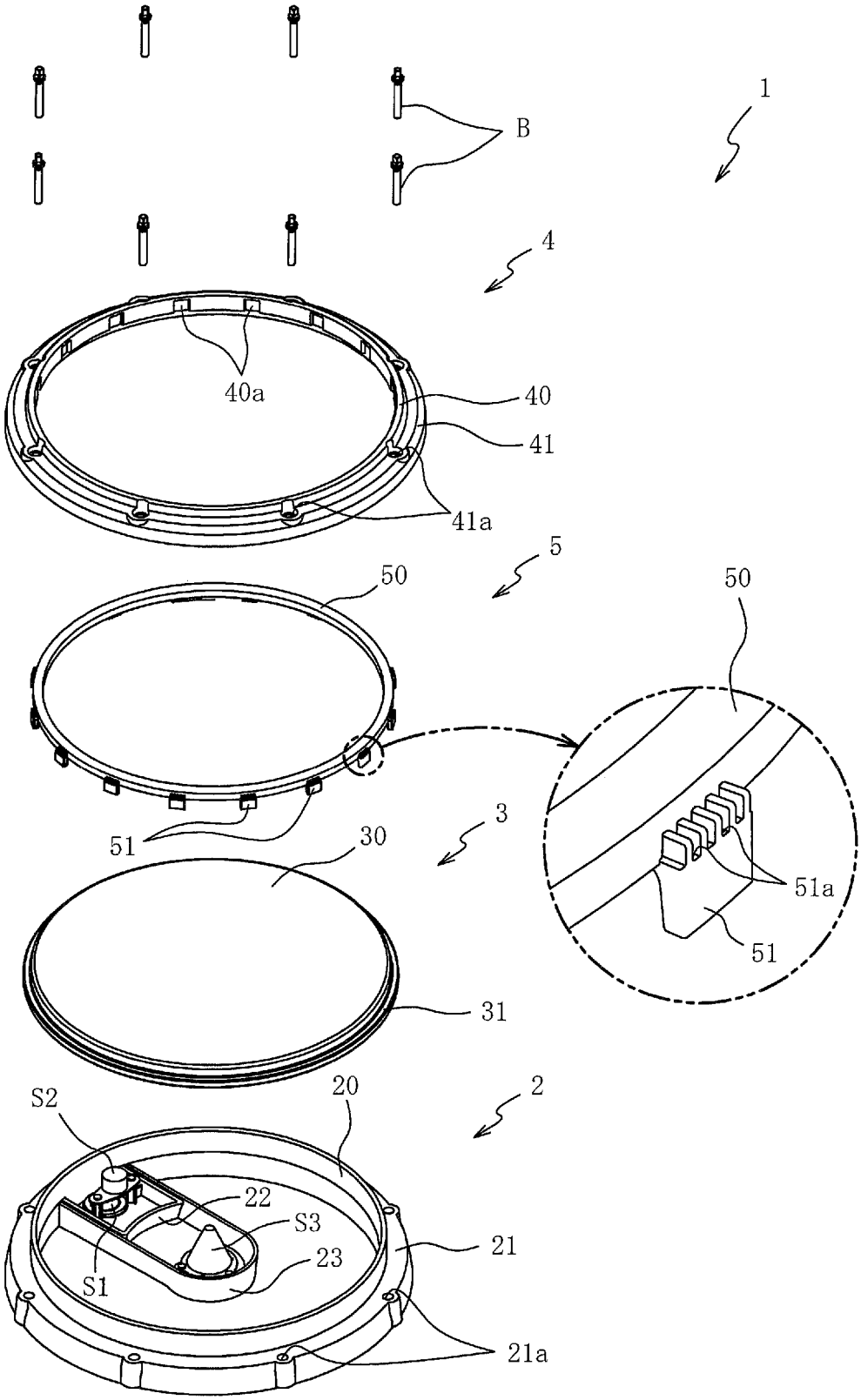
FIG. 1 is an exploded perspective view of an electronic percussion instrument in one embodiment.

Preferable embodiments will be described below with reference to the appended drawings. First, a configuration of an electronic percussion instrument 1 will be described with reference to FIG. 1. FIG. 1 is an exploded perspective view of the electronic percussion instrument 1 in one embodiment.

As shown in FIG. 1, the electronic percussion instrument 1 is an electronic percussion instrument that simulates a drum, and includes a cylindrical body part 2, a head 3 that covers an opening of the body part 2, a hoop 4 that applies tension to the head 3, and a rim 5 that protects the hoop 4 being struck and is clamped between the head 3 and the hoop 4.

The body part 2 includes a cylindrical part 20 having a cylindrical shape of which both upper and lower ends are open, an annular fixing part 21 that protrudes radially outward from the outer circumferential surface on the lower end side of the cylindrical part 20, a box-shaped first support part 22 which protrudes from the inner circumferential surface of the cylindrical part 20 toward the axis of the cylindrical part 20 and of which the upper end side is open, and a box-shaped second support part 23 surrounding the first support part 22 which protrudes from the inner circumferential surface of the cylindrical part 20 toward the axis of the cylindrical part 20 and of which the upper end side is open, and is formed using a resin material (in the present embodiment, glass reinforced nylon).

The cylindrical part 20 is a part for supporting the head 3, and the fixing part 21 is a part for fastening and fixing the hoop 4 with a bolt B. A female screw hole 21*a* that vertically extends and has a female screw on its inner circumferential surface is formed on the upper surface of the fixing part 21. A plurality of (in the present embodiment, 8) female screw holes 21*a* are formed at equal intervals in the circumferential direction.

A rim sensor S1 and a first head sensor S2 are supported on the first support part 22, and a second head sensor S3 is supported on the second support part 23. In addition, a substrate (not shown) for processing signals detected by sensors and the like are supported on the first support part 22 and the second support part 23.

The rim sensor S1 is a sensor configured to detect vibration of the cylindrical part 20. The rim sensor S1 is configured as a piezoelectric element that is adhered to the bottom surface of the first support part 22 using cushioning double-sided tape.

The first head sensor S2 is a sensor configured to detect vibration of striking on the struck surface edge side of the head 3 (a film part 30). The first head sensor S2 includes a plate fixed to a pair of columnar parts that stand up from the bottom surface of the first support part 22, a piezoelectric element that is adhered to the upper surface of the plate using cushioning double-sided tape, and a cushion member that is adhered to the upper surface of the piezoelectric element.

The second support part 23 is detachably fixed to the first support part 22 with a bolt (not shown) and extends from the inner circumferential surface of the cylindrical part 20 to a region including the axis of the cylindrical part 20. The second head sensor S3 is supported on the extension tip side of the second support part 23 and disposed at a position overlapping the axis of the cylindrical part 20.

The second head sensor S3 is a sensor configured to detect vibration of striking in the vicinity of the center of the struck surface of the head 3 (the film part 30). The second head sensor S3 includes a plate fixed to a plurality of columnar parts that stand up from the bottom surface of the second support part 23, a piezoelectric element that is adhered to the upper surface of the plate using cushioning double-sided tape, and a cushion member that is adhered to the upper surface of the piezoelectric element.

The head 3 includes the disk-shaped film part 30 whose upper surface is configured as a struck surface, an annular frame part 31 that is connected to the outer edge of the film part 30 and applies tension to the film part 30. The film part 30 is formed using a mesh-like material obtained by knitting synthetic fibers or a synthetic resin, and the frame part 31 is formed using a metal material (or a resin material). When the frame part 31 is pressed downward by the hoop 4, tension is applied to the film part 30.

The hoop 4 includes an annular part 40 having an annular shape and a fixed part 41 that protrudes radially outward from the outer circumferential surface of the annular part 40 and is continuously formed in the circumferential direction of the annular part 40, and is formed using a resin material (in the present embodiment, glass reinforced nylon).

In the fixed part 41, a plurality of (in the present embodiment, 8) through-holes 41*a* that vertically extend are formed at equal intervals in the circumferential direction. When the bolt B inserted into the through-hole 41*a* is screwed into the female screw hole 21*a* of the fixing part 21, the hoop 4 is fixed to the body part 2.

In the annular part 40 of the hoop 4, a housing part 40*a* recessed from its inner circumferential surface directed outward in the radial direction is formed and a clamped part 51 of the rim 5 can be housed in the housing part 40*a*. The housing part 40*a* is configured as recesses with a shape (in the present embodiment, a rectangular parallelepiped) corresponding to the outer shape of the clamped part 51 and a plurality of (in the present embodiment, 16) housing parts are formed at equal intervals in the circumferential direction of the annular part 40.

The rim 5 is a member for striking when a performer performs a technique simulating a rim shot and also protects the hoop 4 being struck. The rim 5 includes an annular struck part 50 and the substantially rectangular parallelepiped clamped part 51 that protrudes radially outward from the outer circumferential surface of the struck part 50 and is suspended downward and is formed using a rubber-like elastic component.

A plurality of (in the present embodiment, 16) clamped parts 51 are formed at equal intervals in the circumferential direction, and the clamped part 51 has recesses 51*a* recessed on the outer circumferential surface of the clamped part 51 toward an inside in the radial direction of the clamped part 51. A plurality of (in the present embodiment, 4) recesses 51*a* are formed in the upper end part of the clamped part 51 and formed on the outer circumferential surface of the clamped part 51 in the circumferential direction. As will be described below, when the recesses 51*a* are formed in the clamped part 51, elastic deformation of the clamped part 51 is allowed.

Figure 2:
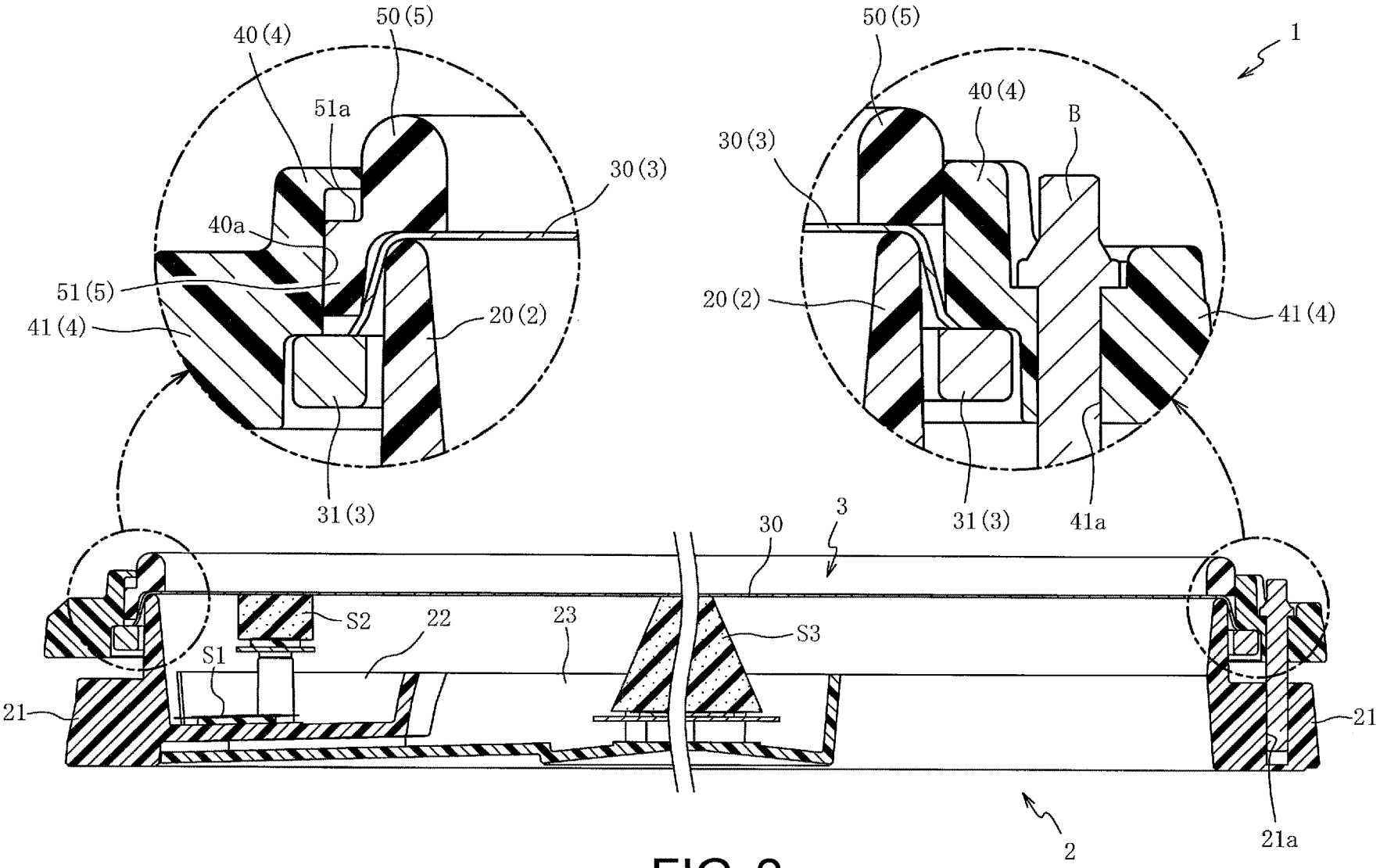
FIG. 2 is a cross-sectional view of the electronic percussion instrument.

Next, a detailed configuration of the electronic percussion instrument 1 will be described with reference to FIG. 2. FIG. 2 is a cross-sectional view of the electronic percussion instrument 1. Here, a cross section cut in a plane along the axis of the cylindrical part 20 is shown in FIG. 2. A cross section cut at a position at which the clamped part 51 (the recesses 51*a*) of the rim 5 is formed is shown on the left side in FIG. 2, and a cross section cut at a position at which the bolt B is fastened is shown on the right side in FIG. 2. The symbol 50 (5) in FIG. 2 means the struck part 50 of the rim 5, the other symbols marked as the same way are the same meanings.

As shown in FIG. 2, since the inner diameter (the outer diameter of the film part 30) of the frame part 31 of the head 3 is set to be larger than the outer diameter of the cylindrical part 20, when an opening of the cylindrical part 20 is covered with the film part 30, the frame part 31 is disposed on the outer circumferential side of the cylindrical part 20.

When the film part 30 is connected to the upper surface on the inner circumferential side of the frame part 31, a part of the upper surface on the outer circumferential side of the frame part 31 is exposed. Since the inner diameter of the annular part 40 (a part in which the housing part 40*a* is not formed) of the hoop 4 is set to be smaller than the outer diameter of the frame part 31, when the exposed part of the upper surface of the frame part 31 is pushed downward by the annular part 40 (the fixed part 41 is fastened and fixed to the fixing part 21 with the bolt B), tension is applied to the film part 30.

In this case, when the fixed part 41 is fixed to the fixing part 21 while the clamped part 51 is housed in the housing part 40*a* of the annular part 40, the clamped part 51 is clamped between the film part 30 positioned on the outer circumferential side of the cylindrical part 20 and the housing part 40*a*. Therefore, the struck part 50 is fixed to the inner circumferential side of the hoop 4.

Here, a state in which tension is applied to the film part 30 is defined as a "tensioned state." In the tensioned state, the first head sensor S2 and the second head sensor S3 are in contact with the lower surface of the film part 30 and vibration generated when the upper surface (struck surface) of the film part 30 is struck is detected by the first head sensor S2 and the second head sensor S3.

In addition, in the tensioned state, since the struck part 50 is supported on the cylindrical part 20 via the film part 30, vibration generated when the struck part 50 is struck is transmitted to the rim sensor S1 through the film part 30, the cylindrical part 20, and the first support part 22.

Results of detection by the rim sensor S1 and the first and second head sensors S2 and S3 are output to a sound generator (not shown), and a musical tone signal based on the detection results is generated by the sound generator. When this musical tone signal is output to an amplifier or a speaker (both are not shown), an electronic musical sound based on the musical tone signal is emitted from the speaker.

In this case, since the upper end of the struck part 50 is positioned above the upper end of the annular part 40 in the tensioned state, when a performer performs a technique simulating a rim shot, the struck part 50 can be struck. Therefore, the hoop 4 (the annular part 40) can be protected from being struck by the struck part 50. In addition, since the rim 5 is formed using a rubber-like elastic component, it is possible to reduce a striking sound when the struck part 50 is struck.

Since the inner diameter of the struck part 50 is set to be (for example, 4 mm) slightly smaller than the diameter of the cylindrical part 20, and the outer diameter of the struck part 50 is set to be (for example, 4 mm) slightly larger than the diameter of the cylindrical part 20, the bottom surface of the struck part 50 and the edge of the opening of the cylindrical part 20 are disposed at vertically overlapping positions. That is, since the inner edge of the bottom surface of the struck part 50 is positioned on the inner circumferential side of the cylindrical part 20 and the outer edge of the bottom surface of the struck part 50 is positioned on the outer circumferential side of the cylindrical part 20, the bottom surface of the struck part 50 is supported on the edge of the opening of the cylindrical part 20 via the film part 30. Therefore, vibration generated when the struck part 50 is struck is easily directly transmitted to the cylindrical part 20 through the film part 30.

In addition, since the diameter of the struck part 50 and the diameter of the edge of the opening of the cylindrical part 20 are set to be substantially the same, vibration generated when the struck part 50 is struck is easily directly transmitted to the cylindrical part 20 through the film part 30. Here, the "diameter" is a value obtained by averaging the inner diameter and the outer diameter of the cylindrical part 20 (the struck part 50).

In addition, in the struck part 50, a part on the lower end side has a solid form with a substantially rectangular cross-section, and the bottom surface of the struck part 50 in a region positioned above the cylindrical part 20 with the film part 30 therebetween is formed flat (a shape along the upper surface of the film part 30). Therefore, compared to a case in which recesses are formed in a struck part as in the related art, it is possible to reduce elastic deformation of the struck part 50 according to striking. Therefore, since it is possible to reduce a striking force applied to the struck part 50 being buffered by the struck part 50, vibration generated when the struck part 50 is struck is easily directly transmitted to the cylindrical part 20 through the film part 30.

In addition, since the outer diameter of the struck part 50 is set to be the same as the inner diameter of the annular part 40 (or slightly larger than (for example, 2 mm) thereof), the entire struck part 50 (or a part thereof) is in contact with the inner circumferential surface of the annular part 40. In addition, the housing part 40*a* is formed in a shape corresponding to the clamped part 51, and in the tensioned state, the upper end of the clamped part 51 is in contact with the upper surface of the housing part 40*a*.

Here, in the case of a configuration in which recesses are formed in a rim cover as in the related art (Japanese Unexamined Patent Application Publication No. 2007-249141) and the recesses are fitted to a frame to fix the rim cover, in order to secure releasability when the recesses in the rim cover are released from a mold during molding and workability for fitting the recesses in the rim cover to the frame, it is necessary to use a rubber material having a relatively low JIS-A hardness (hardness based on a JIS type A durometer in JIS K6253 (2012 edition), hereinafter, simply referred to as "hardness") (for example, a hardness is less than 70). Therefore, a feeling of striking when the rim cover is struck becomes too soft compared to an acoustic drum and the rim cover is easily damaged according to striking.

On the other hand, in the present embodiment, since the clamped part 51 is clamped between the housing part 40*a* and the film part 30 and thus the struck part 50 can be fixed to the inner circumferential side of the hoop 4, it is not necessary to form recesses as in the related art in the struck part 50 (the struck part 50 can have a solid form). Therefore, even if the struck part 50 is formed using a rubber material with a relatively high hardness (for example, a hardness of 90), it is possible to reduce deterioration of the releasability during molding and the workability for a fitting operation. That is, since the struck part 50 can be formed using a rubber material with a higher hardness than that of the related art, a feeling of striking when the struck part 50 is struck is similar to that of an acoustic drum and it is possible to prevent damage to the struck part 50 according to striking.

In addition, since the struck part 50 can have a solid form using a rubber material with a relatively high hardness, it is possible to more effectively reduce a striking force applied to the struck part 50 being buffered by the struck part 50. Therefore, since vibration generated when the struck part 50 is struck is easily directly transmitted to the cylindrical part 20 through the film part 30, the vibration can be efficiently transmitted to the rim sensor S1.

Here, for example, a configuration in which the first support part 22 is continuously formed in the circumferential direction of the inner circumferential surface of the cylindrical part 20 can be used. However, in such a configuration, since the first support part 22 easily picks up noise (for example, a musical sound (air vibration) from an instrument or a speaker near the electronic percussion instrument 1 and air vibration generated when the film part 30 is struck), there is a risk of such noise being erroneously detected by the rim sensor S1.

On the other hand, in the present embodiment, the first support part 22 is connected to a partial region (for example, a region that is ⅛ or less of the circumferential length of the inner circumferential surface of the cylindrical part 20) in the circumferential direction of the inner circumferential surface of the cylindrical part 20 (the rim sensor S1 in a cantilevered state is supported on the inner circumferential surface of the cylindrical part 20 by the first support part 22). Therefore, since it is possible to reduce picking up of noise by the first support part 22, it is possible to reduce erroneous detection of noise by the rim sensor S1. In addition, since the first support part 22 can be reduced in size compared to when the first support part 22 is continuously formed in the circumferential direction of the inner circumferential surface of the cylindrical part 20, it is possible to reduce the product cost (an amount of a resin used) of the body part 2.

On the other hand, when the first support part 22 is connected to a partial region of the inner circumferential surface of the cylindrical part 20, vibration generated when the struck part 50 is struck at a position away from the first support part 22 (the rim sensor S1) is not easily transmitted to the rim sensor S1. However, as described above, the present embodiment has a configuration in which the struck part 50 is disposed above the edge of the opening of the cylindrical part 20, and vibration generated when the struck part 50 is struck is easily directly transmitted to the cylindrical part 20 through the film part 30.

Therefore, even if the first support part 22 is connected to a partial region of the inner circumferential surface of the cylindrical part 20, vibration generated when the struck part 50 is struck at a position away from the first support part 22 (the rim sensor S1) can be efficiently transmitted to the rim sensor S1. Therefore, it is possible to reduce erroneous detection of noise by the rim sensor S1 and it is possible to easily detect vibration generated when the struck part 50 is struck by the rim sensor S1. Thus, it is possible to accurately generate a musical sound based on striking the film part 30 and the struck part 50.

Here, as described above, the housing part 40*a* is formed in a shape corresponding to the clamped part 51, and in the tensioned state, the upper end of the clamped part 51 is in contact with the upper surface of the housing part 40*a*. Therefore, the clamped part 51 may be pressed downward by the hoop 4 depending on a degree of tension applied to the film part 30.

Therefore, for example, in a configuration in which the recesses 51*a* are not formed in the clamped part 51, when the clamped part 51 is pressed downward by the hoop 4, there is a risk of an excessive load being applied to a part connecting the struck part 50 and the clamped part 51 and there is a risk of downward displacement of the hoop 4 being inhibited due to a reaction force of the clamped part 51. Therefore, there is a risk of the rim 5 being damaged and desired tension not being applied to the film part 30.

On the other hand, in the present embodiment, since the clamped part 51 has recesses 51*a* recessed on the outer circumferential surface of the clamped part 51 toward an inside in the radial direction of the clamped part 51, it is possible to secure a crushing margin for the clamped part 51. That is, since the recesses 51*a* are formed as recesses obtained by cutting out the clamped part 51 in a slit shape and are formed by cutting from the outer circumferential surface of the clamped part 51 to the outer circumferential surface of the struck part 50, when the clamped part 51 is pressed downward by the hoop 4, the clamped part 51 (a part in which the recesses 51*a* are formed) can be elastically deformed.

Therefore, it is possible to reduce an excessive load applied to a part connecting the struck part 50 and the clamped part 51 and reduce inhibition of downward displacement of the hoop 4 due to a reaction force of the clamped part 51. Therefore, it is possible to prevent damage to the rim 5 and it is possible to apply desired tension to the film part 30.

In this case, if only for the purpose of making the clamped part 51 to be easily elastically deformed, for example, a configuration in which the recesses 51*a* are continuously formed from the upper end to the lower end of the clamped part 51 may be used. However, in such a configuration, the clamped part 51 is easily pulled out from between the housing part 40*a* and the film part 30 due to an external force.

On the other hand, in the present embodiment, the recesses 51*a* are formed only in a partial region on the upper end side of the clamped part 51 and the recesses 51*a* are not formed in a region on the lower end side of the clamped part 51. Therefore, even if an external force with which the clamped part 51 falls out from between the housing part 40*a* and the film part 30 is applied to the struck part 50, since a part (a part in which the recesses 51*a* are not formed) on the lower end side of the clamped part 51 is caught on the upper surface of the housing part 40*a*, it is possible to prevent the clamped part 51 from being pulled out from between the housing part 40*a* and the film part 30.

In order to more effectively prevent the clamped part 51 from being pulled out, for example, a configuration in which the clamped part 51 is continuously formed in the circumferential direction of the struck part 50 can be used. However, in such a configuration, the housing part 40*a* needs to be formed also in a region in which the bolt B is inserted (refer to an enlarged part on the right side in FIG. 2). Since it is necessary to secure the rigidity of the hoop 4 in the region in which the bolt B is inserted, when the housing part 40*a* is formed in such a region, the thickness of the annular part 40 in the radial direction needs to be increased accordingly. Therefore, the electronic percussion instrument increases in size.

On the other hand, in the present embodiment, the clamped part 51 is intermittently formed in the circumferential direction of the struck part 50. Therefore, the housing part 40*a* is intermittently formed in the circumferential direction of the annular part 40 and the housing part 40*a* is formed in a region not overlapping the bolt B in the circumferential direction (the housing part 40*a* is formed at a position not overlapping the bolt B (the through-hole 41*a*) when viewed in the radial direction from the inner circumferential side of the hoop 4). Therefore, it is possible to secure the rigidity of the annular part 40 in the region in which the bolt B is inserted.

Therefore, since it is not necessary to form the thickness of the annular part 40 in the radial direction to be thicker than necessary in order to secure the rigidity of the hoop 4, it is possible to reduce the size of the electronic percussion instrument 1 in the radial direction. In addition, since the clamped part 51 and the housing part 40*a* are intermittently formed in the circumferential direction, rotation of the struck part 50 in the circumferential direction can be restricted according to engagement between the clamped part 51 and the housing part 40*a*.

In addition, the thickness dimension of the clamped part 51 in the radial direction is set to be smaller than the thickness dimension of the frame part 31 in the radial direction, and the outer circumferential surface of the clamped part 51 is positioned radially inward from the outer circumferential surface of the frame part 31. Therefore, the inner surface of the housing part 40*a* that faces the outer circumferential surface of the clamped part 51 can be positioned radially inward from the outer circumferential surface of the frame part 31.

Therefore, it is possible to secure a contact area between the lower surface of the annular part 40 and the upper surface of the frame part 31 also in a region in which the housing part 40*a* is formed. That is, even if the housing part 40*a* is formed in the annular part 40, since the entire circumference of the frame part 31 can be pushed by the annular part 40, tension can be uniformly applied to the entire film part 30.

Figure 3:
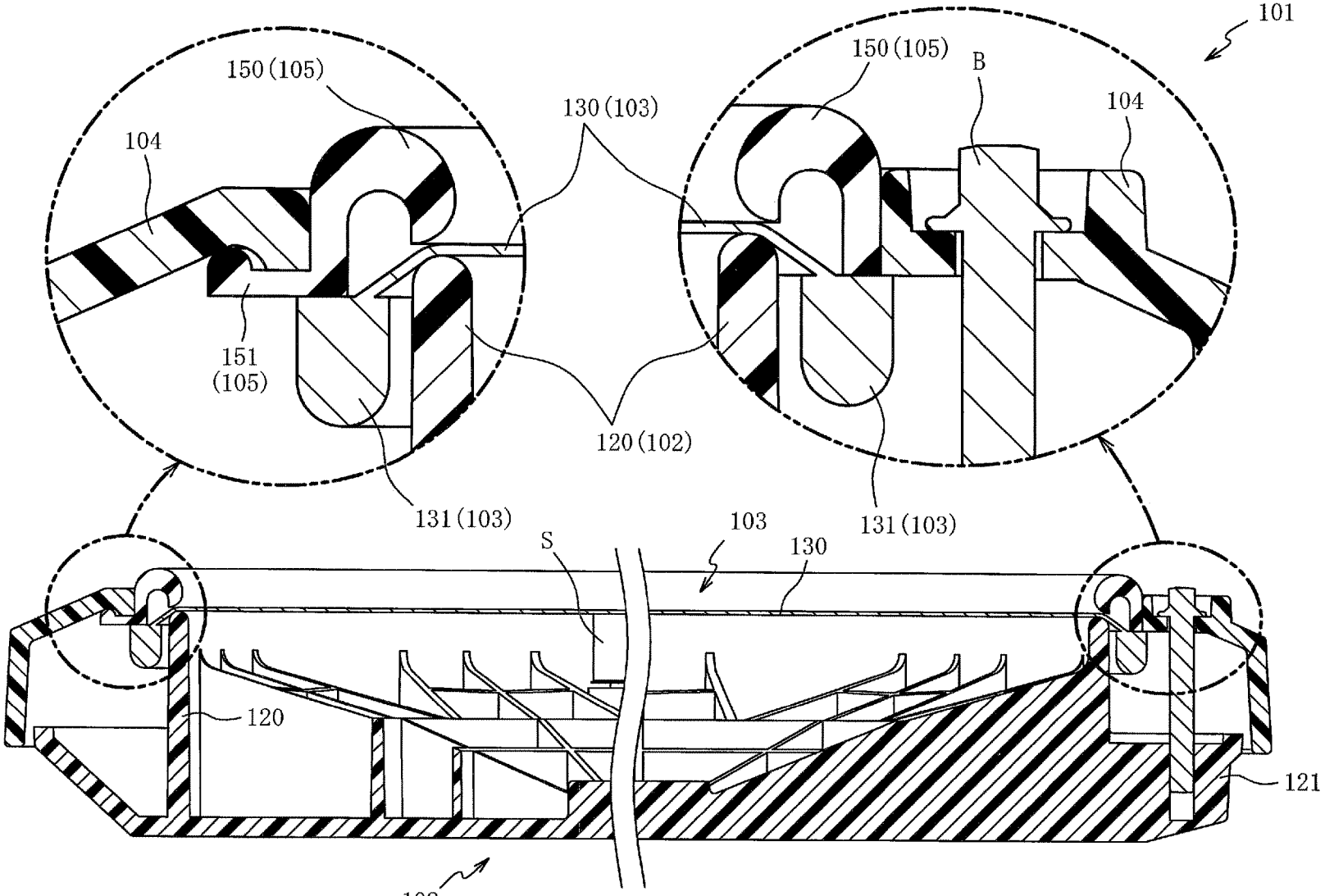
FIG. 3(RELATED ART)
FIG. 3 is a cross-sectional view of an electronic percussion instrument of the related art.

In addition, since the clamped part 51 is clamped between the film part 30 and the housing part 40*a*, compared to when a clamped part 151 is clamped between a hoop 104 and a frame part 131 as in an electronic percussion instrument 101 of the related art (refer to FIG. 3), it is possible to prevent a force of the hoop 4 (a fastening force of the bolt B) that presses the frame part 31 downward from being applied to the clamped part 51. Therefore, it is possible to reduce an excessive load applied to the clamped part 51 and reduce inhibition of downward displacement of the hoop 4 due to a reaction force of the clamped part 51. Therefore, it is possible to prevent damage to the rim 5 and it is possible to apply desired tension to the film part 30.

While the disclosure has been described above based on the above embodiment, the disclosure is not limited to the above embodiment, and it can easily understood that various modifications and alternations can be made without departing from the spirit and scope of the disclosure.

While a case in which the body part 2 and the hoop 4 are formed using a resin material (glass reinforced nylon) has been described in the above embodiment, the disclosure is not necessarily limited thereto. For example, a configuration in which the body part 2 and the hoop 4 are formed using another resin material, metal material, wood material, or the like may be used.

While a case in which the rim 5 is formed using rubber with a hardness of 90 has been described in the above embodiment, the disclosure is not necessarily limited thereto. For example, the rim 5 may be formed using a soft (for example, a hardness of less than 70) rubber material or another resin material (for example, a hard elastomer), but the rim 5 is preferably formed using a hard rubber material with a hardness of 70 or more and 95 or less.

When the rim 5 is formed using a rubber material with a hardness of 70 or more, it is possible to reduce a striking force being buffered by the struck part 50 and it is possible to efficiently transmit vibration to the rim sensor S1. In addition, when the rim 5 is formed using a rubber material with a hardness of 95 or less, it is possible to reduce a striking sound generated when the struck part 50 is struck.

While a case in which the clamped part 51 is clamped between the film part 30 and the housing part 40*a* and thus the rim 5 (the struck part 50) is fixed to the inner circumferential side of the hoop 4 has been described in the above embodiment, the disclosure is not necessarily limited thereto. For example, a configuration in which the rim 5 (the struck part 50) is adhered to the inner circumferential surface of the hoop 4 may be used. In this case, the housing part 40*a* of the hoop 4 and the clamped part 51 of the rim 5 may be omitted.

While a case in which the struck part 50 has a solid form has been described in the above embodiment, the disclosure is not necessarily limited thereto. For example, the inside of the struck part 50 may have a hollow shape, and when at least the bottom surface of the struck part 50 is supported on the edge of the opening of the cylindrical part 20 via the film part 30, it is possible to efficiently transmit vibration generated when the struck part 50 is struck to the rim sensor S1.

While a case in which the clamped part 51 is formed in a substantially rectangular parallelepiped has been described in the above embodiment, the disclosure is not necessarily limited thereto. For example, the clamped part 51 may be formed in any polyhedron shape, a columnar shape, or a prismatic shape as long as the shape can prevent falling out from between the housing part 40*a* and the film part 30. Irrespective of the shape of the clamped part 51, the housing part 40*a* may be formed in a shape corresponding (engageable with) to the shape.

While a case in which the clamped parts 51 and the housing parts 40*a* are formed at equal intervals in the circumferential direction of the struck part 50 has been described in the above embodiment, the disclosure is not necessarily limited thereto. For example, the clamped parts 51 and the housing parts 40*a* may be formed at unequal intervals in the circumferential direction. In addition, a configuration in which the clamped parts 51 and the housing parts 40*a* are continuously formed in the circumferential direction may be used.

While a case in which the slit-shaped recesses 51*a* are formed in a part on the upper end side of the clamped part 51 and the recesses 51*a* are formed by cutting out from the outer circumferential surface of the clamped part 51 to the outer circumferential surface of the struck part 50 has been described in the above embodiment, the disclosure is not necessarily limited thereto. A configuration in which the formation position, the shape, and the cut-out depth of the recesses 51*a* can be appropriately set and the recesses 51*a* are not formed may be used. Therefore, for example, a configuration in which the recesses 51*a* are continuously formed from the upper end to the lower end of the clamped part 51 may be used, and the recesses 51*a* may be formed in a partial region such as the lower end side or the center in the vertical direction of the outer circumferential surface of the clamped part 51.

While a case in which the first support part 22 is connected to a partial region of the inner circumferential surface of the cylindrical part 20 in the circumferential direction has been described in the above embodiment, the disclosure is not necessarily limited thereto. For example, a configuration in which the first support part 22 is continuously connected to the inner circumferential surface of the cylindrical part 20 in the circumferential direction may be used.

While a case in which the second head sensor S3 is disposed in the second support part 23 has been described in the above embodiment, the disclosure is not necessarily limited thereto. For example, a configuration in which the second support part 23 and the second head sensor S3 are omitted may be used. In addition, a configuration in which the second support part 23 and the second head sensor S3 are included and the first head sensor S2 is omitted may be used.

In addition, a configuration in which an opening on the lower end side of the cylindrical part 20 is blocked to form a bottom surface and the rim sensor S1, the first head sensor S2, and the second head sensor S3 are supported on the bottom surface may be used. In this case, the first head sensor S2 may be omitted and the rim sensor S1 may be disposed at the center of the bottom surface.

While a case in which the rim sensor S1 is disposed in the first support part 22 has been described in the above embodiment, the disclosure is not necessarily limited thereto. For example, a configuration in which the rim sensor S1 is disposed on the inner circumferential surface of the cylindrical part 20 or the fixing part 21 may be used.

While a case in which the rim sensor S1 is configured as a piezoelectric element has been described in the above embodiment, the disclosure is not necessarily limited thereto. For example, another sensor configured to detect vibration (for example, an electrodynamic or electrostatic capacity type sensor) may be used to constitute the rim sensor S1.

While a case in which the first and second head sensors S2 and S3 include a piezoelectric element has been described in the above embodiment, the disclosure is not necessarily limited thereto. For example, a pressure sensor, an electrostatic sensor, a laser sensor, or a magnet sensor may be used to constitute the first and second head sensors S2 and S3.

What is claimed is:

1. An electronic percussion instrument comprising:

a body part having an opening on at least one end side of the body part;

a head that covers the opening of the body part;

a hoop for applying tension to the head, a rim which is disposed on an inner circumferential side of the hoop and of which an upper end is positioned above an upper end of the hoop and of which a bottom surface is supported on an edge of the opening of the body part via the head; and a rim sensor that detects vibration generated when the rim is struck and is disposed in the body part, wherein the hoop surrounds the rim from an outer circumferential surface of the rim.

2. The electronic percussion instrument according to claim 1, wherein the rim includes a struck part that is supported on the edge of the opening of the body part via the head, and a clamped part that protrudes from an outer edge of the struck part toward the body part and is clamped between the head and the hoop on an outer circumferential side of the body part.

3. The electronic percussion instrument according to claim 2, wherein the clamped part is intermittently formed in a circumferential direction of the rim.

4. The electronic percussion instrument according to claim 3, wherein the hoop has a housing part which is recessed radially outward on an inner circumferential surface of the hoop and in which the clamped part is housed.

5. The electronic percussion instrument according to claim 4, comprising a bolt that fastens and fixes the hoop to the body part, wherein the hoop includes a through-hole which penetrates the hoop vertically and into which the bolt is inserted, and wherein the housing part is formed at a position not overlapping the through-hole in a circumferential direction of the hoop.

6. The electronic percussion instrument according to claim 2, wherein the clamped part has recesses recessed on an outer surface of the clamped part from an outside toward an inside in a radial direction of the clamped part.

7. The electronic percussion instrument according to claim 6, wherein the recesses are formed in a region at least on an upper end side of the clamped part.

8. The electronic percussion instrument according to claim 1, wherein the rim sensor is disposed on an inner circumferential surface of the body part.

9. The electronic percussion instrument according to claim 1, wherein the body part is formed in a cylindrical shape having openings on both of one end side and the other end side of the body part.

10. The electronic percussion instrument according to claim 1, wherein the rim has a solid form.

11. An electronic percussion instrument comprising:

a body part having an opening on at least one end side of the body part;

a head that covers the opening of the body part;

a rim of which a bottom surface is supported on an edge of the opening of the body part via the head;

a rim sensor that detects vibration generated when the rim is struck and is disposed in the body part; and a hoop for applying tension to the head, wherein the rim is clamped between the head and the hoop and including a struck part that is disposed above the edge of the opening of the body part, wherein a bottom surface of the struck part and the edge of the opening of the body part are positioned at vertically overlapping positions.

12. The electronic percussion instrument according to claim 11, wherein an inner edge of a bottom surface of the rim is positioned on an inner circumferential side of the edge of the opening of the body part.

13. The electronic percussion instrument according to claim 12, wherein the rim has a clamped part that protrudes from an outer edge of the struck part toward the body part and is clamped between the head and the hoop on an outer circumferential side of the body part.

14. The electronic percussion instrument according to claim 13, wherein the clamped part is intermittently formed in a circumferential direction of the rim.

15. The electronic percussion instrument according to claim 14, wherein the hoop has a housing part which is recessed radially outward on an inner circumferential surface of the hoop and in which the clamped part is housed.

16. The electronic percussion instrument according to claim 15, comprising a bolt that fastens and fixes the hoop to the body part, wherein the hoop includes a through-hole which penetrates the hoop vertically and into which the bolt is inserted, and wherein the housing part is formed at a position not overlapping the through-hole in a circumferential direction of the hoop.

17. The electronic percussion instrument according to claim 13, wherein the clamped part has recesses recessed on an outer surface of the clamped part from an outside toward an inside in a radial direction of the clamped part.

18. The electronic percussion instrument according to claim 17, wherein the recesses are formed in a region at least on an upper end side of the clamped part.

19. A method of detecting vibration generated when a rim of an electronic percussion instrument is struck, comprising:

using a head, covering an opening of a body part which has the opening on at least one end side of the body part;

providing a hoop surrounding the rim from an outer circumferential surface of the rim;

applying, using the hoop, tension to the head;

disposing the rim on an inner circumferential side of the hoop, and supporting a bottom surface of the rim on an edge of the opening of the body part via the head so that an upper end of the rim is positioned above an upper end of the hoop; and disposing a rim sensor in the body part and detecting vibration generated when the rim is struck by the rim sensor.

* * * * *